US008077875B2

(12) United States Patent
Hung et al.

(10) Patent No.: US 8,077,875 B2
(45) Date of Patent: Dec. 13, 2011

(54) AUDIO DEVICE

(75) Inventors: Chun-Lung Hung, Taipei Hsien (TW); Kun Huang, Shenzhen (CN); Shao-Lin Zhang, Shenzhen (CN); De-An Zhang, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 432 days.

(21) Appl. No.: 12/483,227

(22) Filed: Jun. 11, 2009

(65) Prior Publication Data

US 2009/0316926 A1 Dec. 24, 2009

(30) Foreign Application Priority Data

Jun. 19, 2008 (CN) ..... 2008 1 0302219

(51) Int. Cl.
*H04R 5/033* (2006.01)

(52) U.S. Cl. ..... 381/74; 381/309; 381/370; 381/123; 455/232.1; 455/234.1; 455/234.2

(58) Field of Classification Search ..... 381/74, 381/123, 309, 120, 80, 72, 370; 455/232.1, 455/234.1, 234.2; 330/148
See application file for complete search history.

(56) References Cited

U.S. PATENT DOCUMENTS

| | | | | |
|---|---|---|---|---|
| 6,069,960 | A * | 5/2000 | Mizukami et al. | 381/74 |
| 6,961,594 | B2 * | 11/2005 | Rankin | 455/574 |
| 6,984,990 | B2 * | 1/2006 | Shin | 324/538 |
| 2005/0201568 | A1 * | 9/2005 | Goyal | 381/74 |
| 2006/0182289 | A1 * | 8/2006 | Chu | 381/86 |

* cited by examiner

*Primary Examiner* — Vivian Chin
*Assistant Examiner* — David Ton
(74) *Attorney, Agent, or Firm* — Altis Law Group, Inc.

(57) ABSTRACT

An audio device includes a jack, a switch, an amplifier, an internal sound producer, and a determining circuit. The jack establishes a connection with an external sound producer. The switch is in an opened state when the connection is established, and in a closed state when the connection is open. The amplifier amplifies audio signals to amplified audio signals and sends the amplified audio signals to the switch. The determining circuit receives the amplified audio signals from the switch, and generates a high voltage to control the amplifier not to output the amplified audio signals to the internal sound producer when the switch is in the closed state, and generates a low voltage to control the amplifier to output the amplified audio signals to the internal sound producer. The determined circuit further filters out the amplified audio signals when the switch is in the opened state.

18 Claims, 2 Drawing Sheets

AUDIO DEVICE

BACKGROUND

1. Technical Field

The present disclosure generally relates to audio devices.

2. Description of Related Art

Audio devices, such as MP3 (MPEG-1 audio layer III) players, MP4 (MPEG-4) players, CD (compact disc) players, and so on, are widely used. An audio device reproduces audio signals, amplifies the audio signals by an amplifier, and outputs amplified audio signals by an internal sound producer such as speaker. An earphone jack is usually defined in the audio device, so that an external sound producer such as an earphone can be detachably connected to the audio device via the earphone jack to output the amplified audio signals.

The audio device further includes a controller to generate a control signal, which is used for controlling the amplifier to output the amplified audio signals to one of the internal speaker and the external earphone. When the external earphone is not connected to the audio device, the amplified audio signals are sent to the internal speaker. When the external earphone is connected to the audio device, the amplified audio signals are sent to the external earphone.

However, the control signal may be disturbed by the amplified audio signals especially when the amplified audio signals are outputted to the internal speaker. As a result, the audible sound outputted by the speaker may be intermittent and has a low sound quality. Therefore, an audio device with good sound quality is desired.

Other advantages and novel features will become more apparent from the following detailed description of an exemplary embodiment when taken in conjunction with the accompanying drawings.

DETAILED DESCRIPTION

Figure 1:
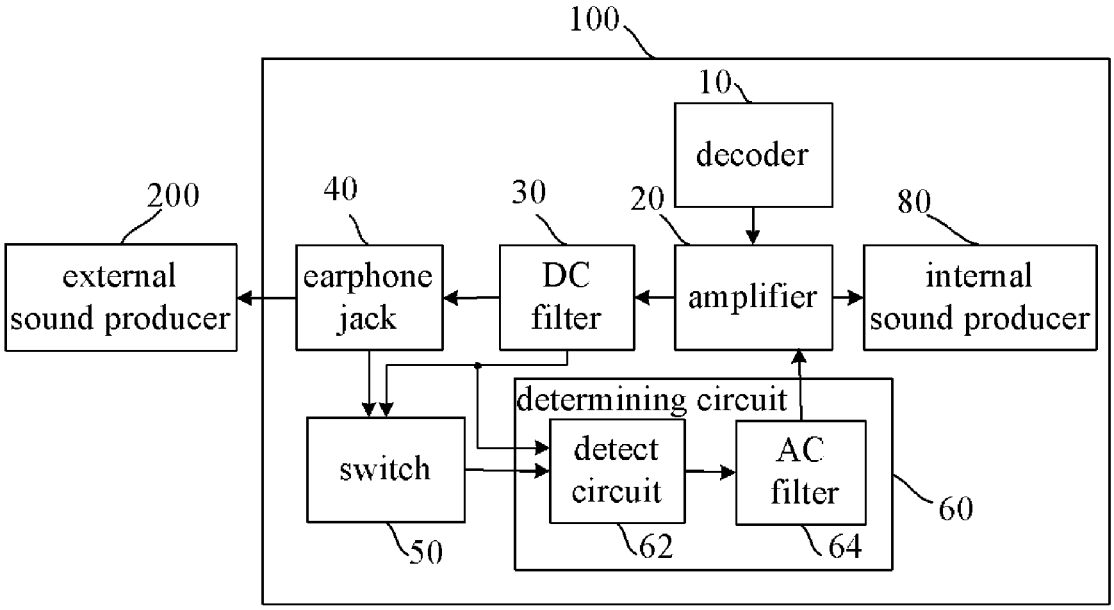
FIG. 1 is a block diagram showing an audio device in accordance with an exemplary embodiment.

Referring to FIG. 1, an audio device 100 in accordance with an exemplary embodiment. The audio device 100 includes a decoder 10, an amplifier 20, a direct current (DC) filter 30, an earphone jack 40, a switch 50, a determining circuit 60, and an internal sound producer 80. An external sound producer 200 is electrically connected to the audio device 100 via the earphone jack 40. The external sound producer 200 may be an earphone or an external speaker with a plug inserted in the earphone jack 40 for establishing a connection between the external sound producer 200 and the audio device 100.

The amplifier 20 is electrically connected to the decoder 10. The DC filter 30 is electrically connected between the amplifier 20 and earphone jack 40. The switch 50 is electrically connected to the earphone jack 40 in a closed state when the earphone jack 40 is not connected to the external sound producer 200, and disconnected from the earphone jack 40 in an opened state when the earphone jack 40 is electrically connected to the external sound producer 200. The switch 50 is also electrically connected between the DC filter 30 and the determining circuit 60. The determining circuit 60 is electrically connected to the amplifier 20 and the DC filter 30. The internal sound producer 80 is electrically connected to the amplifier 20.

The decoder 10 is configured for reproducing audio signals from audio files stored in a medium, such as an optical disc. The audio signals are alternating current (AC) signals which may include noise, such as DC signals. The amplifier 20 receives the audio signals and amplifies the audio signals to a desired voltage level, thereby, generating amplified audio signals. The DC filter 30 filters out the noise from the amplified audio signals, and then transmits the filtered audio signals to the earphone jack 40. The DC filter 30 further transmits the filtered audio signals to the determining circuit 60 via the switch 50 in the closed state. The determining circuit 60 includes a detect circuit 62 electrically connected to the switch 50, and an alternating current (AC) filter 64 electrically connected between the detect circuit 62 and the amplifier 20. The detect circuit 62 generates a high voltage signal when the switch 50 is in the opened state. The detect circuit 62 generates a low voltage signal and receives the filtered audio signals from the switch 50 when the switch 50 is in the closed state. The AC filter 64 filters out the filtered audio signals (AC signals) from the detect circuit 62 to transmit the voltage signals to the amplifier 20. Therefore, the amplifier 20 is guarded from interference by the filtered signals.

Figure 2:
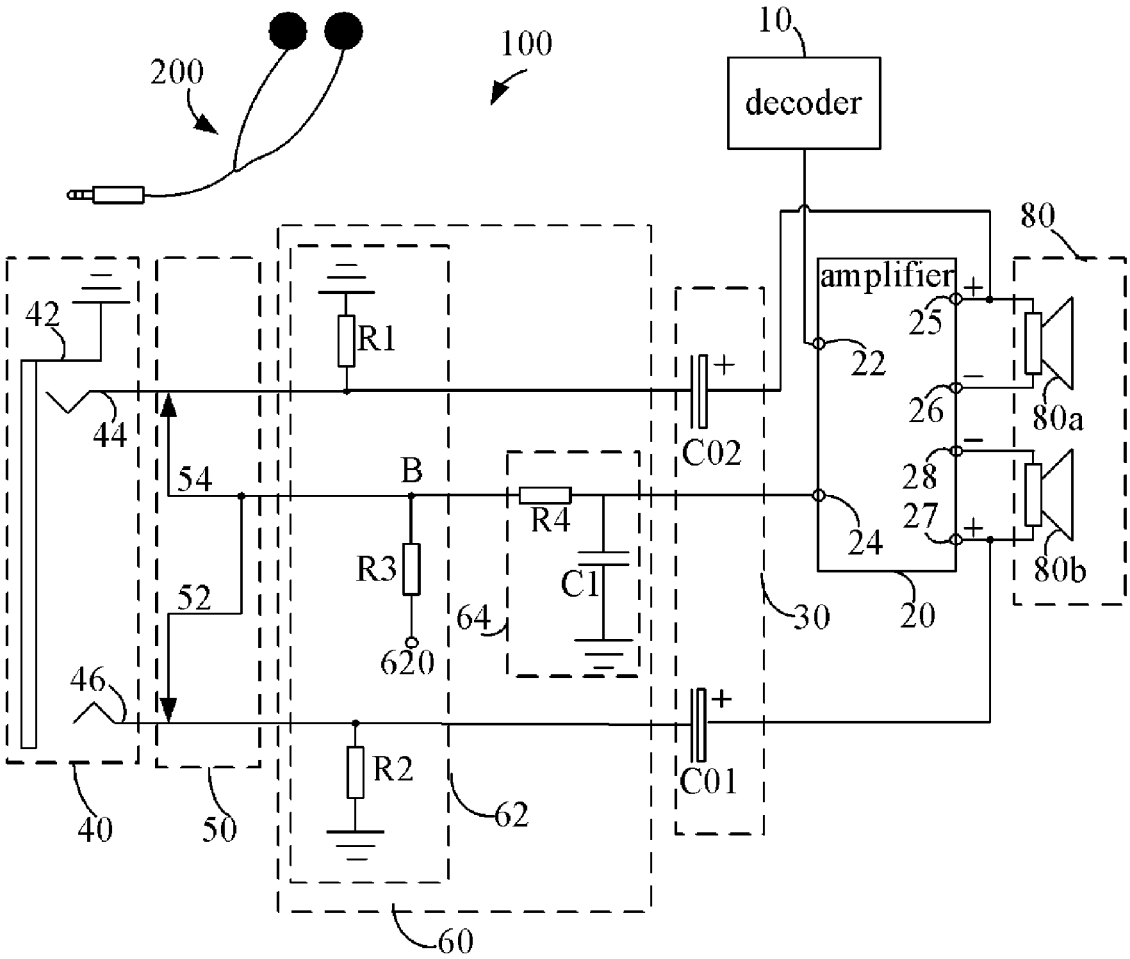
FIG. 2 is a circuit diagram showing an audio device in accordance with an exemplary embodiment.

Referring to the FIG. 2, the amplifier 20 includes an input terminal 22, a control terminal 24, a pair of positive output terminals 25, 27, and a pair of negative output terminals 26, 28. The input terminal 22 is electrically connected to the decoder 10, and the control terminal 24 is electrically connected to the determining circuit 60. The amplifier 20 receives the audio signals from the decoder 10 via the input terminal 22, and receives the high voltage signal and the low voltage signal from the determining circuit 60 via the control terminal 24. The amplifier 20 is capable of amplifying the audio signals, and then outputting the amplified audio signals via the positive output terminals 25, 27 and the negative output terminals 26, 28 correspondingly. In this embodiment, the amplified audio signals are all in a normal phase when the amplifier 20 receives the high voltage signal. The amplified audio signals outputted via the positive output terminals 25, 27 are in a normal phase, and the amplified audio signals outputted via negative output terminals 26, 28 are in a reverse phase when the amplifier 20 receives the low voltage signal.

The DC filter 30 includes two electrolytic capacitors C01, C02. The positive pins of the two electrolytic capacitors C01, C02 are electrically connected to the positive output terminals 25, 27 respectively. The DC filter 30 is capable of filtering out the DC signals from the amplified audio signals and then outputting the filtered audio signals via the negative pins of the electrolytic capacitors C01, C02.

The earphone jack 40 includes a ground terminal 42, and two conductive terminals 44, 46 aligned with each other. First ends of the conductive terminals 44, 46 are electrically connected to the negative pins of the electrolytic capacitors C01, C02 respectively. When the switch 50 is in the opened state, second ends of the conductive terminals 44, 46 are not in contact with each other. When the switch 50 is in the closed state, the second ends of the conductive terminals 44, 46 are both electrically connected to the plug of the external sound producer 200 and move away from each other by the plug to make the space between them larger. As a result, the earphone jack 40 receives the filtered audio signals from the DC filter 30 and then sends filtered audio signals to the external sound producer 200 when the switch 50 is in the opened state.

The switch 50 includes two contacts 52, 54. First ends of contacts 52, 54 are connected with each other. Second ends of contacts 52, 54 are electrically connected to the conductive terminals 44, 46 by default that the switch 50 is in the closed state, and disconnected from the conductive terminals 44, 46 that the switch 50 is in the opened state when the external sound producer 200 is connected to the earphone jack 40.

The detect circuit 62 includes a first resistor R1, a second resistor R2, a third resistor R3, and a power supply 620. One end of the first resistor R1 is grounded and the other end of the resistor R1 is electrically connected to the negative pin of electrolytic capacitor C01 and the conductive terminal 44 of the earphone jack 40. One end of the second resistor R2 is grounded, and the other end of the second resistor R2 is electrically connected to the negative pin of the electrolytic capacitor C02 and the conductive terminal 46 of the earphone jack 40. A first end of third resistor R3 is electrically connected to the power supply 620, the second end of the third resistor R3 is electrically connected to a node B. The node B is electrically connected to the first ends of contacts 52, 54 of the switch 50 and the AC filter 64 such that the third resistor R3 will be disconnected from the first resistor R1 and the second resistor R2 when the contacts 52, 54 of the switch 50 are disconnected from the conductive terminals 44, 46 of the earphone jack 40. In this embodiment, the power supply 620 provides a DC voltage V1.

The AC filter 64 includes a fourth resistor R4 and a capacitor C1. One end of the fourth resistor R4 is electrically connected to the node B, the other end of the resistor R4 is electrically connected to the control terminal 24 and to capacitor C1. The other end of the capacitor C1 is grounded.

The internal sound producer 80 includes two internal speakers 80*a*, 80*b*. The speaker 80*a* is electrically connected between the positive output terminal 25 and the negative output terminal 26. The speaker 80*b* is electrically connected between the positive output terminal 27 and the negative output terminal 28.

When the external sound producer 200 is connected to the earphone jack 40, the audio device operates as follows.

The contacts 52, 54 of the switch 50 are disconnected from the conductive terminals 44, 46 of the earphone jack 40 when the switch 50 is in the opened state. The first resistor R1 and the second resistor R2 are disconnected from the third resistor R3. The DC voltage V1 provided by the power supply 620 is transmitted to the third resistor R3 but not transmitted to the first resistor R1 and the second resistor R2, the voltage of the node B is substantially V1, e.g., the high voltage. The amplifier 20 receives a high voltage signal via the control terminal 24, and outputs the normal phase amplified audio signals via the positive output terminals 25, 27 and the negative output terminals 26, 28. So the amplified audio signals from the positive output terminals 25, 27 counteract the amplified audio signals from the negative output terminals 26, 28, that disables from outputting sound.

When the external sound producer 200 is not connected to the earphone jack 40, the audio device 100 operates as follows.

The contacts 52, 54 of the switch 50 are connected to the conductive terminals 44, 46 of the earphone jack 40 respectively. The DC voltage V1 provided by the power supply 620 is transmitted to the first resistor R1, the second resistor R2, and the resistor R3. As a result, the voltage of the node B provided by the power supply 620 is VA=V1*((R2+R2)*R3/(R1+R2+R1*R2)), the VA is the low voltage.

In that case, the amplifier 20 outputs the amplified audio signals to the earphone jack 40. Because the switch 50 is in the closed state, the amplified audio signals from the electrolytic capacitor 25, 27 flow to the node B. Provided that a peak value of the amplified audio signals flowing to the node B is VS, the voltage of the node B may be VA+VS at every predetermined time interval. If VS is large enough, the voltage of node B may be at the high voltage level at interval. The capacitor C1 of the AC filter 64 filters out the amplified audio signals not flowing to the control terminal 20. Therefore, the amplifier 20 receives the low voltage signal via the control terminal 24, outputs the normal phase amplified audio signals via the positive output terminals 25, 27 and outputs reverse amplified audio signals via the negative output terminals 26, 28. So the amplified audio signals from the positive output terminals 25, 27 are added to the amplified audio signals from the negative output terminals 26, 28, that enable the speakers 80*a*, 80*b* to output audible sound.

The audio device described above uses the determining circuit to generated control signals (the high voltage signal and the low voltage signal) to control the amplifier to selectively output audio signals to the internal sound producer and the external sound producer, and further prevents the control signals from interference, so that the internal sound producer outputs sound with little to no noise and the audio device has good sound quality.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An audio device comprising:

a jack for establishing a connection with an external sound producer;

a switch being in an opened state when the connection of the jack and the external sound producer is established, and in a closed state when the connection is open an amplifier for amplifying audio signals and sending the amplified audio signals to the switch;

an internal sound producer for receiving the amplified audio signals from the amplifier and converting the amplified audio signals to sound; and a determining circuit for receiving the amplified audio signals from the switch, and generating a high voltage to control the amplifier not to output the amplified audio signals to the internal sound producer when the switch is in the opened state, and generating a low voltage to control the amplifier to output the amplified audio signals to the internal sound producer and further filtering out the amplified audio signals when the switch is in the closed state.

2. The audio device of claim 1, wherein the determining circuit comprises a detect circuit and an alternating current (AC) filter, the detect circuit generates the high voltage signal and the low voltage signal, and receives the amplified audio signals, the AC filter filters out the amplified audio signals and then transmits the high voltage signal and the low voltage signal to the amplifier.

3. The audio device of claim 2, further comprising a direct current (DC) filter for filtering out the noise from the amplified audio signals before the amplified audio signals are transmitted to the switch.

4. The audio device of claim 3, wherein the DC filter comprises two electrolytic capacitors, the positive pins are electrically connected amplifier, the electrolytic capacitors receives the amplified audio signals via the positive pins and outputs the filtered audio signals via the negative pins.

5. The audio device of claim 4, wherein the jack comprises two conductive terminals, the switch comprises two contacts, first ends of the two contacts are connected together, second ends of the two contacts are electrically connected to the two conductive terminals respectively, the switch is in the closed state when the connection is open and disconnected from the conductive terminals, the switch is in the opened state when the connection is established.

6. The audio device of claim 5, wherein the detect circuit comprises a first resistor, a second resistor, a third resistor, and a power supply, one end of the first resistor and the second resistor are grounded, and the other end of each of the first resistor and the second resistor is electrically connected to one negative pins of electrolytic capacitors and one conductive terminal of the jack, a first end of the third resistor is electrically connected to the power supply, and a second end of the third resistor is electrically connected to the first ends of the switch and the AC filter.

7. The audio device of claim 6, wherein the AC filter comprises a fourth resistor and a capacitor, one end of the fourth resistor is electrically connected to the second end of the third resistor, and the other end of the fourth resistor is electrically connected to the amplifier and to capacitor, the other end of the capacitor is grounded.

8. The audio device of claim 7, wherein the amplifier comprises an input terminal, a control terminal electronically connected to the DC filter, a pair of positive terminals, and a pair of negative terminals, the internal sound producer comprises two speakers, the positive terminals are electrically connected to the positive pins of the electrolytic capacitors respectively, each speaker electrically connected between one of positive terminals and one of the negative terminals, the amplifier receives the audio signals via the input terminal, receives the high voltage signal and the low voltage signal via the control terminal, and outputs the amplifier audio signals via the positive terminals and the negative terminals.

9. The audio device of claim 1, further comprising a decoder for generating the audio signals.

10. An audio device comprising:

a jack detachably and electrically connected to an external sound producer;

a switch electrically connected to the jack in a closed state when the jack is not connected to the external sound producer, and disconnected from the jack in an opened state when the jack is connected to the external sound producer;

an amplifier electrically connected to the jack and amplifying audio signals to amplified audio signals, and sending the amplified audio signals to the switch;

an internal sound producer electrically connected to the amplifier for receiving the amplified audio signals from the amplifier and converting the amplified audio signals to sounds;

a determining circuit electrically connected to the amplifier and the switch for receiving amplified audio signals, and generating a high voltage to control the amplifier not to output the amplified audio signals to the internal sound producer when the switch is in the opened state, and generating a low voltage to control the amplifier to output the amplified audio signals to the internal sound producer and further filtering out the amplified audio signals when the switch is in the closed state.

11. The audio device of claim 10, wherein the determining circuit comprises a detect circuit and an alternating current (AC) filter, the detect circuit generates the high voltage signal and the low voltage signal, and receives the amplified audio signals, the AC filter filters the amplified audio signals and then transmits the high voltage signal and the low voltage signal to the amplifier.

12. The audio device of claim 11, further comprising a direct current (DC) filter for filtering out the noise from the amplified audio signals before the amplified audio signals are transmitted to the switch.

13. The audio device of claim 12, wherein the DC filter comprises two electrolytic capacitors, the positive pins are electrically connected to the amplifier, the electrolytic capacitors receives the amplified audio signals via the positive pins and outputs the filtered audio signals via the negative pins.

14. The audio device of claim 13, wherein the jack comprises two conductive terminals, the switch comprises two contacts, first ends of the two contacts are connected together, second ends of the two contacts are electrically connected to the two conductive terminals respectively that the switch is in the closed state when the connection is open, and disconnected from the conductive terminals that the switch is in opened state when the connection is established.

15. The audio device of claim 14, the detect circuit comprises a first resistor, a second resistor, a third resistor, and a power supply, one end of the first resistor and the second resistor are grounded, and the other end of each of the first resistor and the second resistor is electrically connected to one negative pins of electrolytic capacitors and one conductive terminal of the jack, a first end of the third resistor is electrically connected to the power supply, and a second end of the third resistor is electrically connected to the first ends of the switch and the AC filter.

16. The audio device of claim 15, wherein the AC filter comprises a fourth resistor and a capacitor, one end of the fourth resistor is electrically connected to the second end of the third resistor, and the other end of the fourth resistor is electrically connected to the amplifier and grounded via the capacitor.

17. The audio device of claim 16, wherein the amplifier comprises an input terminal, a control terminal electronically connected to the DC filter, a pair of positive terminals, and a pair of negative terminals, the internal sound producer has two speakers, the positive terminals are electrically connected to the positive pins of the electrolytic capacitors respectively, each speaker electrically connected between one of positive terminals and one of the negative terminals, the amplifier receives the audio signals via the input terminal, receives the high voltage signal and the low voltage signal via the control terminal, and outputs the amplifier audio signals via the positive terminals and the negative terminals.

18. The audio device of claim 10, further comprising a decoder for generating the audio signals.

* * * * *